US011466693B2

(12) United States Patent
Liu et al.

(10) Patent No.: US 11,466,693 B2
(45) Date of Patent: Oct. 11, 2022

(54) ELECTRIC BLOWER

(71) Applicant: GUANGDONG WELLING MOTOR MANUFACTURING CO., LTD., Guangdong (CN)

(72) Inventors: Junlong Liu, Guangdong (CN); Hongbo Liu, Guangdong (CN); Wen Fan, Guangdong (CN)

(73) Assignee: GUANGDONG WELLING MOTOR MANUFACTURING CO., LTD., Foshan (CN)

( * ) Notice: Subject to any disclaimer, the term of this patent is extended or adjusted under 35 U.S.C. 154(b) by 57 days.

(21) Appl. No.: 17/217,137

(22) Filed: Mar. 30, 2021

(65) Prior Publication Data

US 2021/0215159 A1 Jul. 15, 2021

Related U.S. Application Data

(63) Continuation of application No. PCT/CN2018/115373, filed on Nov. 14, 2018.

(30) Foreign Application Priority Data

Sep. 30, 2018 (CN) ..... 201811162788.0

(51) Int. Cl.

| | |
|---|---|
| ***F04D 29/05*** | (2006.01) |
| ***F04D 25/08*** | (2006.01) |
| ***F04D 29/056*** | (2006.01) |
| ***F04D 29/60*** | (2006.01) |

(52) U.S. Cl.

CPC ..... *F04D 25/08* (2013.01); *F04D 29/056* (2013.01); *F04D 29/601* (2013.01)

(58) Field of Classification Search

None

See application file for complete search history.

(56) References Cited

FOREIGN PATENT DOCUMENTS

| | | | | |
|---|---|---|---|---|
| CN | 105275863 | A | | 1/2016 |
| CN | 205622459 | U | | 10/2016 |
| CN | 107171466 | A | | 9/2017 |
| CN | 107171479 | A | | 9/2017 |
| CN | 206785668 | U | | 12/2017 |
| CN | 207315689 | U | * | 5/2018 |
| CN | 207884406 | U | | 9/2018 |

(Continued)

OTHER PUBLICATIONS

Notice of Reasons for Refusal dated Feb. 8, 2022 received in Japanese Patent Application No. JP 2020-517816 together with an English language translation.

(Continued)

*Primary Examiner* — Michael Lebentritt

(74) *Attorney, Agent, or Firm* — Scully Scott Murphy & Presser

(57) ABSTRACT

A high speed electric blower is provided. A rotor assembly of the blower has a bearing, a moving impeller and a magnetic ring. A housing of the blower has a bearing chamber. The diameter of the magnetic ring is smaller than the diameter of the bearing chamber. The magnetic ring can pass through the bearing chamber. The moving impeller and the magnetic ring are respectively located at either end of the bearing chamber. The single bearing is located between the moving impeller and the magnetic ring of the rotating shaft.

14 Claims, 11 Drawing Sheets

(56) References Cited

FOREIGN PATENT DOCUMENTS

| | | | | | |
|---|---|---|---|---|---|
| CN | 208605376 | U | * | 3/2019 | ..... A47L 5/14 |
| EP | 3208914 | B1 | * | 11/2019 | ..... A47L 5/28 |
| HU | 225638 | B1 | * | 5/2007 | |
| JP | 2014142071 | A | | 8/2014 | |
| JP | 2015232276 | A | | 12/2015 | |
| JP | 2016154426 | A | * | 8/2016 | |
| JP | 2017227156 | A | | 12/2017 | |
| JP | 2019105216 | A | * | 6/2019 | |
| JP | 2020112061 | A | * | 7/2020 | ..... F04D 29/4226 |
| JP | 2021118597 | A | * | 8/2021 | |
| JP | 7044083 | B2 | * | 3/2022 | |
| JP | 7076485 | B2 | * | 5/2022 | ..... B25F 5/008 |

OTHER PUBLICATIONS

International Search Report dated Jun. 21, 2019 received in International Application No. PCT/CN2018/115373 together with an English language translation.

* cited by examiner

ELECTRIC BLOWER

CROSS-REFERENCES TO RELATED APPLICATIONS

The present application is a continuation application of PCT International Application No. PCT/CN2018/115373, filed on Nov. 14, 2018, which claims the priority of Chinese Patent Application No. 201811162788.0, filed with the Chinese Patent Office on Sep. 30, 2018 and entitled "ELECTRIC BLOWER", the entire contents of which are herein incorporated by reference for all purposes. No new matter has been introduced.

FIELD

The present disclosure relates to the technical field of electric blowers, and particularly relates to a high-speed electric blower.

BACKGROUND

The existing electric blower usually supports the rotating shaft through two bearings installed at both ends of the rotating shaft. In order to ensure the working reliability of the electric blower, it is necessary to ensure that the two bearings have high coaxiality, which results in high requirements for the assembly accuracy of the electric blower and complicated assembly.

SUMMARY

The present disclosure solves at least one of the above-mentioned technical problems.

For this reason, the purpose of the present disclosure is to provide an electric blower.

In order to achieve the object, the technical solution of the present disclosure provides an electric blower, comprising: a rotor assembly, comprising a bearing, a moving impeller, and a magnetic ring, and the magnetic ring and the moving impeller respectively installed at both ends of the bearing; and a housing, having a bearing chamber, a diameter of the magnetic ring is smaller than a diameter of the bearing chamber, the magnetic ring can pass through the bearing chamber, and the moving impeller and the magnetic ring are respectively located at both ends of the bearing chamber.

The electric blower provided by the above-mentioned technical solution uses only one bearing, and the bearing is located between the moving impeller and the magnetic ring of the rotating shaft. During assembly, the magnetic ring passes through the bearing chamber. After the installation is completed, the moving impeller and the magnetic ring are located at two ends of the bearing chamber respectively. This assembly method of rotor assembly and housing facilitates assembly and simplifies the assembly process. Since only one bearing is used, the assembly accuracy requirements for rotor assembly and housing are low, which is beneficial to improve assembly efficiency; and the number of electric blower parts is reduced, which is beneficial to reduce product costs and further improve assembly efficiency.

In addition, the electric blower provided in the above-mentioned technical solution of the present disclosure may also have the following additional technical features.

In the above-mentioned technical solution, optionally, an annular step extending radially inwardly is provided in the bearing chamber, the magnetic ring can pass through a middle of the annular step, and the bearing is restricted in the bearing chamber by the annular step.

The axial limit of the bearing is carried out by using the annular step to ensure the accuracy of the assembly position of the bearing and prevent the bearing from falling out of the bearing chamber.

In the above-mentioned technical solution, optionally, the housing is an injection molding housing, the bearing chamber is provided with a bearing positioning hole, an inner wall of the bearing positioning hole is provided with a glue-containing groove, the bearing is installed in the bearing chamber, there is a transitional fit between the bearing and the bearing positioning hole; or the housing is an injection molding housing, the bearing chamber is provided with a bearing positioning hole, an inner wall of the bearing positioning hole is provided with a glue-containing groove, a bearing sleeve is installed in the bearing chamber, there is a transitional fit between the bearing sleeve and the positioning hole, and the bearing is installed in the bearing sleeve.

The housing adopts non-metallic injection molding housing, which can reduce motor loss, thereby improving motor efficiency; at the same time, compared with metal housing, injection molding housing does not generate heat due to eddy current, which accordingly reduces the external working environment temperature of the bearing and improves the reliability of the bearing. There is a bearing positioning hole in the bearing chamber, and a transition fit between the bearing positioning hole and the bearing (or bearing sleeve) is adopted to realize the pre-positioning of the bearing and ensure the coaxiality of the bearing installation, which is beneficial to improve the assembly accuracy of the bearing and ensure the working reliability of the bearing. And the thermosetting glue can be used to bond and fix the bearing chamber and the bearing of the injection molding housing. The glue flows into and fills the containing glue groove to achieve a firm bond between the bearing chamber and the bearing (or bearing sleeve), thereby ensuring the reliability of bearing in high temperature working environment. Moreover, injection molding housing is superior to metal housing in terms of manufacturing cost and weight.

In the above-mentioned technical solution, optionally, the electric blower also comprises a wind hood, the wind hood is installed externally to an end of the housing, and there are adapted mating side surfaces between the housing and the wind hood, wherein one of the mating side surfaces is provided with a pre-positioning rib protruding toward the other mating side surface.

By setting the pre-positioning rib on the mating side surfaces between the housing and the wind hood, the pre-positioning rib plays a pre-positioning role during the assembly of the wind hood and the housing, thereby ensuring the gap between the wind hood and the moving impeller installed inside the wind hood, controls the assembly accuracy of the air duct, and prevents friction caused by the gap deviation of the wind hood and the moving impeller during the assembly process. This ensures the stable performance of the electric blower, and reduces the vibration and noise caused by the poor assembly accuracy of the air duct, thereby ensuring the working efficiency and reliability of the electric blower, and has the advantages of low vibration, low noise, and high fan efficiency, etc.

In the above-mentioned technical solution, optionally, the electric blower further comprises a wind hood, the wind hood is installed externally to an end of the housing, an inner chamfer is formed at an air inlet of the wind hood, and the air inlet is in an open bell mouth shape.

Through the above-mentioned solution, the wind resistance of the air inlet can be reduced, the air flow at the air inlet can be increased, and the flow field of the air at the air inlet can be smoother, which is conducive to improving the working efficiency of the electric blower and reducing the airflow noise, which can significantly improve the performance of the electric blower.

In the above-mentioned technical solution, optionally, the housing comprises a support shell and a diffuser blade provided on the support shell, and the diffuser blade and the support shell are integrally injection molded.

The diffuser blade and the support shell are integrally injection molded to become an integral injection molded housing, eliminating the assembly process of the diffuser blade and the housing, ensuring the stop dimensional accuracy of the diffuser blade plane and the bearing chamber of the housing, and improving the assembly precision of the air duct system, thereby improving the performance of the electric blower, and reducing the vibration and noise caused by the poor assembly accuracy of the air duct part. In addition, the integral injection molding of the diffuser blade and the housing can solve the problem of demoulding marks in the diffuser blade air duct; the above guarantees the smoothness of the air duct and the consistency of assembly, thereby ensuring the stable performance of the electric blower. At the same time, compared with the metal housing, the integrated injection housing reduces the weight and manufacturing cost of the whole machine.

In the above-mentioned technical solution, optionally, the electric blower further comprises a wind hood, the wind hood is installed externally to an end of the housing, the wind hood has a positioning plane that faces away from the air inlet end face of the wind hood, and a surface of the diffuser blade facing the positioning plane is attached to the positioning plane.

The wind hood and the integrated housing realize the axial positioning of the wind hood through the positioning plane on the wind hood and the surface of the diffuser blade, which is convenient for the glue operation between the wind hood and the housing.

In the above-mentioned technical solution, optionally, the electric blower further comprises a wind hood, the wind hood is installed externally to an end of the housing, the wind hood comprises a wind hood body and a diffuser blade provided on the wind hood body, the diffuser blade and the wind hood body are integrally injection molded.

The diffuser blade and the wind hood body adopt integral injection molding, which can avoid the assembly gap between the diffuser blade and the wind hood, thereby ensuring the air-tightness of the air duct system, reducing fluid loss along the way, and improving the performance of the electric blower.

In any of the above-mentioned technical solutions, optionally, the electric blower further comprises a stator core, the housing is provided with an iron core fixing seat, the iron core fixing seat is provided with an iron core positioning slot, and the iron core fixing seat can position the stator core in an axial direction, the iron core positioning slot can position the stator core in a circumferential direction.

When the stator core and the housing are assembled, the iron core fixing seat is used to realize the axial positioning of the stator core, and the iron core positioning slot is used to realize the circumferential positioning of the stator core, which facilitates the subsequent use of glue or screwing to fix the stator core in all directions.

In any of the above-mentioned technical solutions, optionally, the electric blower further comprises a stator core, and the stator core is formed by splicing at least two stator core petals, each of the stator core petals comprises a core body and an insulation structure, and the insulation structure comprises a thin-wall structure wrapped around the core body and a splicing part structure extending outwardly from the thin-wall structure, the splicing part structure is used for splicing the two adjacent stator core petals.

The insulation structure of the stator core not only undertakes the function of electrical insulation, but also undertakes the role of splicing and fastening each of the stator core petals. Compared with the self-splicing structure of the stator core in the prior art, the solution of the present disclosure reduces the weight of the stator core and reduces the iron loss of the stator core, thereby improving the performance of the motor. And this kind of stator core can increase the bonding force between the stator core sheets and the damping of the stator core structure, thereby reducing the noise and vibration of the motor.

In the above-mentioned technical solution, optionally, the insulation structure also comprises a supporting part structure extending outwardly from the thin-wall structure, and the supporting part structure is provided with a positioning hole or a positioning protrusion, and the positioning hole or the positioning protrusion are used to cooperate with a mounting seat of the electric blower to achieve pre-positioning.

The insulation structure of the stator core also plays a role of supporting the entire stator core in the final assembly, and uses the design of the positioning hole or positioning protrusion on the supporting part structure to achieve the pre-positioning function during the assembly of the mounting seat and the stator core, which is convenient for subsequent fixing and wiring between the mounting seat and the stator core.

In the above-mentioned technical solution, optionally, the core body comprises a core yoke, at least one core tooth, and two sub core teeth, the two sub core teeth are both provided inside the core yoke and located at both ends of the core yoke in the circumferential direction, the core tooth is provided inside the core yoke and located between the two sub core teeth; the insulation structure comprises two of the splicing part structures which are respectively opposed to the two sub core teeth and extend along a direction away from a center of the sub core teeth, and at least one of the supporting part structures opposite to the core tooth and extending along a direction away from a center of the core tooth.

The splicing part structure is opposite to the sub core teeth, which is conducive to improving the structural strength of the splicing part structure, thereby increasing the structural strength of the two adjacent stator core petals using the splicing part structure to splice together, thereby increasing the overall strength of the stator core. The supporting part structure is opposite to the core tooth, which is beneficial to improve the structural strength of the supporting part structure, thereby increasing the supporting strength of the supporting part structure to the entire stator core.

In any of the above-mentioned technical solutions, optionally, the electric blower also comprises a stator core and the mounting seat, the stator core is installed inside of one end of the housing, the mounting seat is installed at one end of the stator core away from the housing, and the mounting seat is provided with a terminal slot for accommodating a terminal, a stator assembly is formed between the mounting seat and the stator core by pulling wires and tapping terminals.

In the above-mentioned technical solution, optionally, an end plate is installed at one end of the mounting seat away from the stator core, and the stator assembly and the end plate are connected by terminal welding.

In the above-mentioned technical solution, optionally, the end plate is a PC board.

Additional aspects and advantages of the present disclosure will become apparent in the following description, or are understood by the practice of the present disclosure.

BRIEF DESCRIPTION OF THE DRAWINGS

The above and/or additional aspects and advantages of the present disclosure will become apparent and readily understood from the following description of embodiments in conjunction with the drawings.

The corresponding relationship between the reference signs and component names in FIGS. 1 to FIG. 21 is as follows:

1 wind hood, 11 inner chamfer, 12 mating side surface, 13 pre-positioning rib, 14 positioning plane, 15 wind hood body, 16 diffuser blade, 2 rotor assembly, 20 rotating shaft, 21 bearing, 22 moving impeller, 23 magnetic ring, 3 housing, 31 support shell, 311 mating side surface, 312 pre-positioning rib, 32 diffuser blade, 33 bearing chamber, 330 annular step, 331 bearing positioning hole, 332 glue-containing groove, 34 iron core fixing seat, 35 iron core positioning slot, 4 stator core, 41 core body, 411 core yoke, 412 core teeth, 413 sub core teeth, 42 insulation structure, 421 thin-wall structure, 4211 injection molding process hole, 422 splicing part structure, 4221 raised part, 4222 recessed part, 423 supporting part structure, 4231 positioning hole, 424 composite structure, 5 mounting seat, 6 terminal, 7 PC board, 8 bearing sleeve.

DETAILED DESCRIPTION OF EMBODIMENTS

In order that the above-mentioned objectives, features and advantages of the present disclosure can be understood more clearly, a further detailed description of the present disclosure will be given below in connection with the accompanying drawings and exemplary embodiments. It should be noted that the embodiments of the present disclosure and the features in the embodiments can be combined with each other if there is no conflict.

In the following description, numerous specific details are set forth in order to provide a thorough understanding of the present disclosure. However, the present disclosure may also be implemented in other manners than those described herein. Therefore, the protection scope of the present disclosure is not limited to the exemplary embodiments disclosed below.

Hereinafter, the electric blower according to some embodiments of the present disclosure will be described with reference to FIGS. 1 to 21.

As shown in FIGS. 1 to 21, an electric blower provided according to some embodiments of the present disclosure comprises: a rotor assembly 2 and a housing 3.

Figure 2:
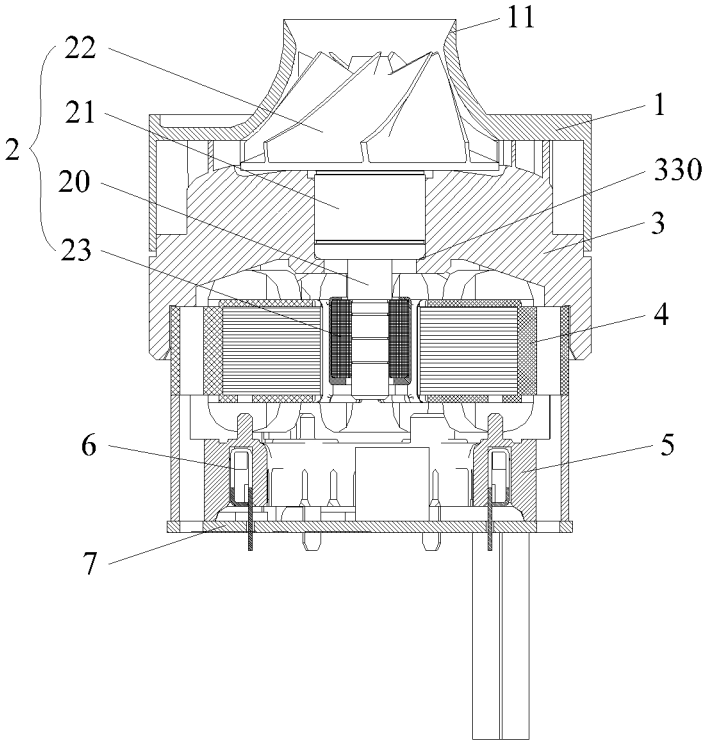
FIG. 2 is a schematic diagram of the cross-sectional structure of an electric blower in an embodiment of the present disclosure.

For example, as shown in FIG. 2, the rotor assembly 2 comprises a bearing 21, a moving impeller 22, and a magnetic ring 23. The bearing 21, the moving impeller 22, and the magnetic ring 23 (that is, the rotor) are all mounted on the rotating shaft 20, and the magnetic ring 23 is located on the side of the rotating shaft 20 away from the moving impeller 22. The diameter of magnetic ring 23 is smaller than the diameter of the bearing 21, and the magnetic ring 23 and the moving impeller 22 are respectively installed at the two ends of bearing 21. The housing 3 has a bearing chamber 33, the diameter of the magnetic ring 23 is smaller than the diameter of the bearing chamber 33, such that the magnetic ring 23 can pass through the bearing chamber 33. After the installation is completed, the moving impeller 22 and the magnetic ring 23 are located at both ends of the bearing chamber 33, respectively.

The electric blower provided in the above-mentioned embodiment uses only one bearing 21, and the bearing 21 is located between the moving impeller 22 and the magnetic ring 23 of the rotating shaft 20. During assembly, the magnetic ring 23 passes through the bearing chamber 33. After the installation is completed, the moving impeller 22 and the magnetic ring 23 are located at two ends of the bearing chamber 33 respectively. This assembly method of rotor assembly 2 and housing 3 facilitates assembly and simplifies the assembly process. Since only one bearing 21 is used, the assembly accuracy requirements for rotor assembly 2 and housing 3 are low, which is beneficial to improve assembly efficiency; and the number of electric blower parts is reduced, which is beneficial to reduce product costs and further improve assembly efficiency.

Further, as shown in FIG. 2, an annular step 330 extending radially inwardly is provided in the bearing chamber 33, the magnetic ring 23 can pass through a central portion of the annular step 330, and the bearing 21 is restricted in the bearing chamber 33 by the annular step 330. The axial limit of the bearing 21 is implemented by the annular step 330 to ensure the accuracy of the assembly position of the bearing 21 and prevent the bearing 21 from falling out of the bearing chamber 33.

Figure 3:
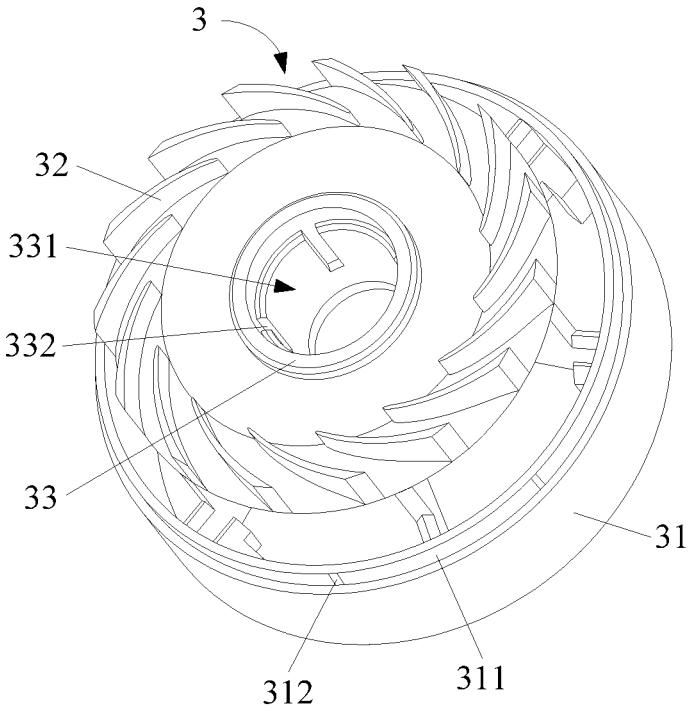
FIG. 3 is a schematic diagram of the housing structure in an embodiment of the present disclosure.
Figure 9:
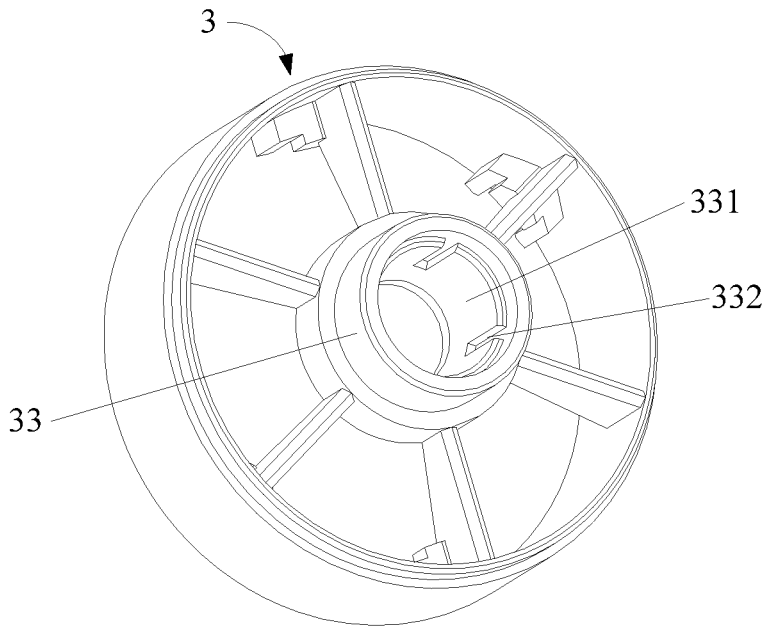
FIG. 9 is a schematic diagram of the housing structure of further another embodiment of the present disclosure.
Figure 11:
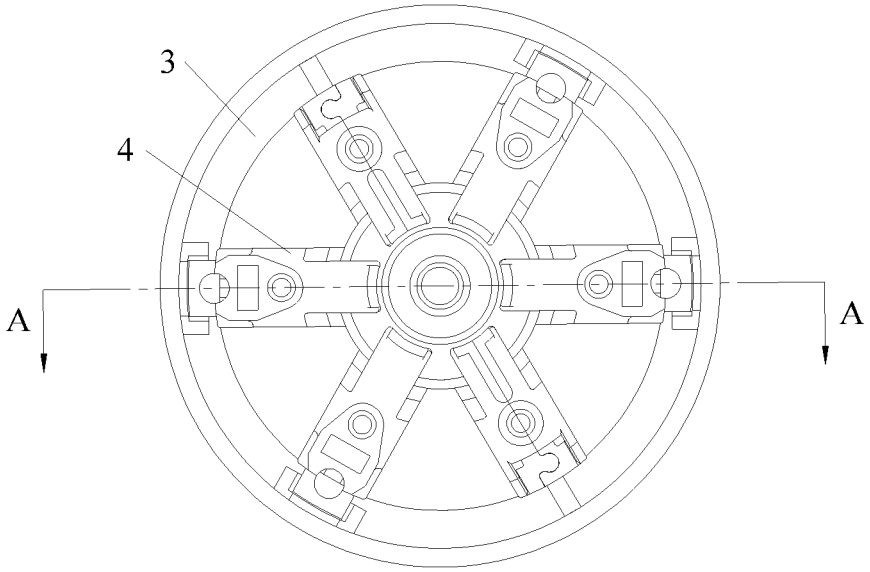
FIG. 11 is a schematic diagram of the assembly structure of the housing, the rotor assembly and the stator core shown in FIG. 9.
Figure 12:
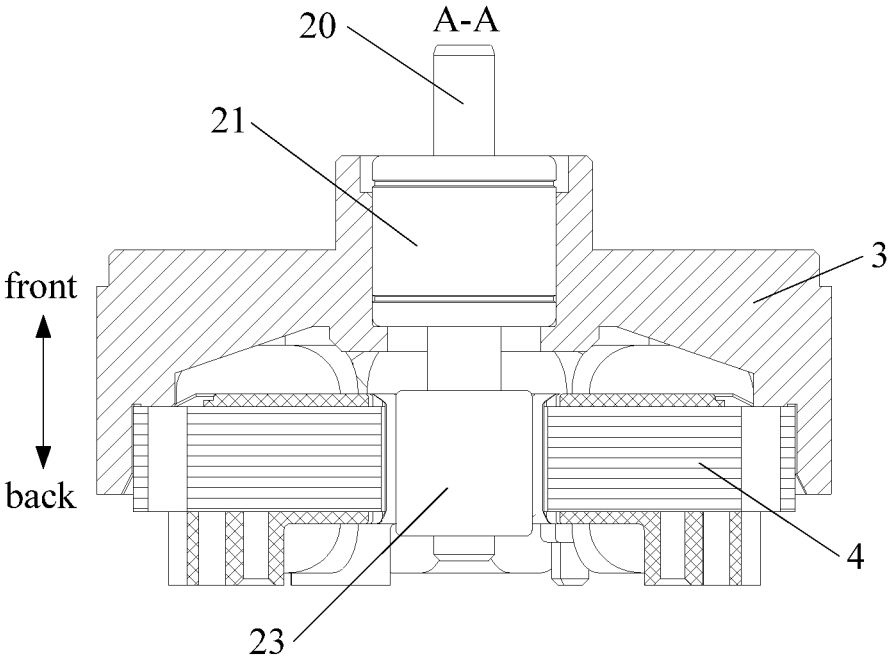
FIG. 12 is a schematic diagram of the cross-sectional structure along the line A-A in FIG. 11.
Figure 13:
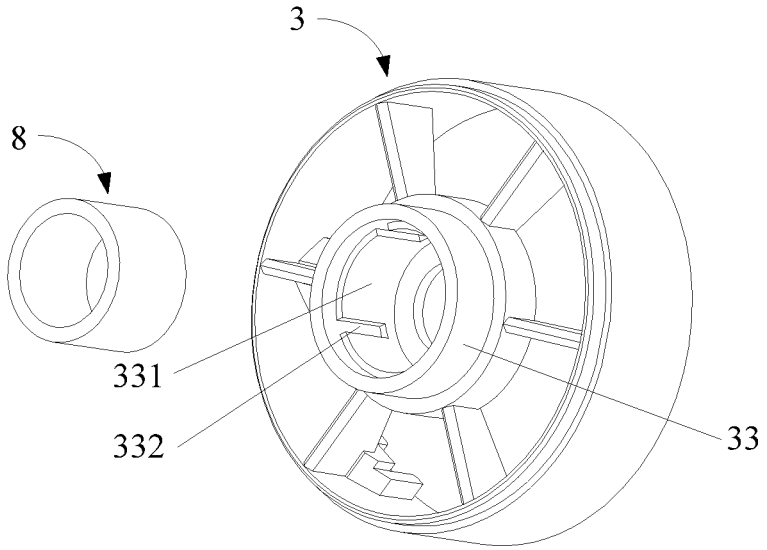
FIG. 13 is a schematic diagram of the structure of the housing and the bearing sleeve in further another embodiment of the present disclosure.

Optionally, as shown in FIGS. 3, 9 and 13, the housing 3 is an injection molding housing, the bearing chamber 33 of the housing 3 is provided with a bearing positioning hole 331, and the inner wall of the bearing positioning hole 331 is provided with a glue-containing groove 332; as shown in FIGS. 11 and 12, the bearing 21 of the rotor assembly 2 is installed in the bearing chamber 33, the bearing 21 and the bearing positioning hole 331 are transitionally matched, and the bearing 21 and the bearing chamber 33 are bonded and fixed by thermosetting glue.

Figure 14:
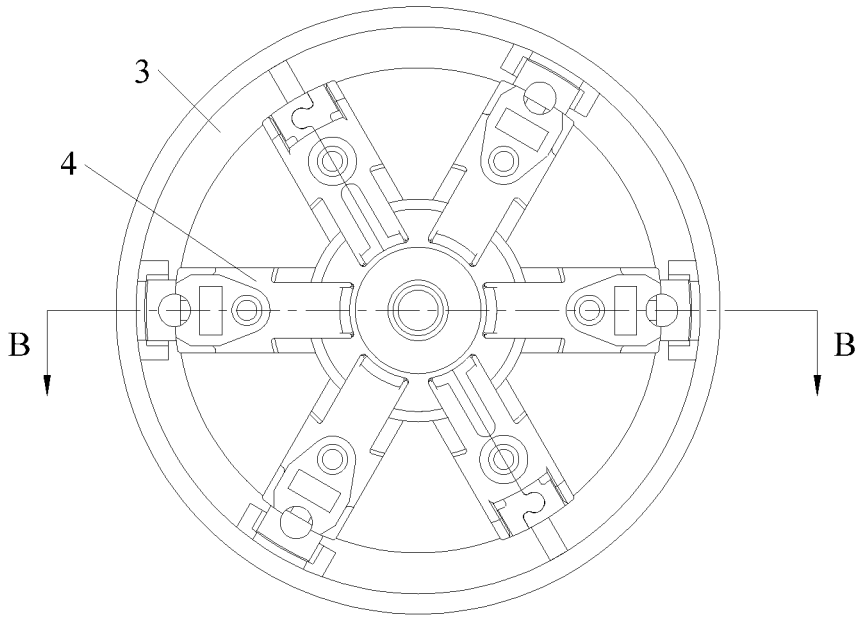
FIG. 14 is a schematic diagram of the assembly structure of the housing, the rotor assembly and the stator core shown in FIG. 13.
Figure 15:
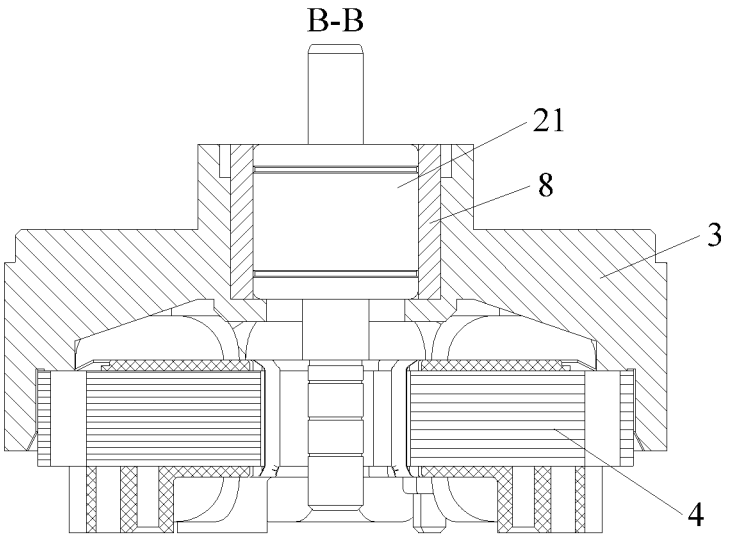
FIG. 15 is a schematic diagram of the cross-sectional structure along the line B-B in FIG. 14.
Figure 16:
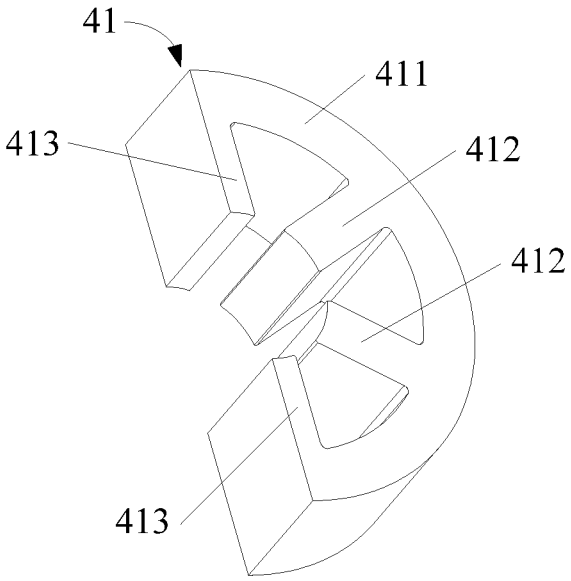
FIG. 16 is a schematic diagram of the core body structure in an embodiment of the present disclosure.
Figure 17:
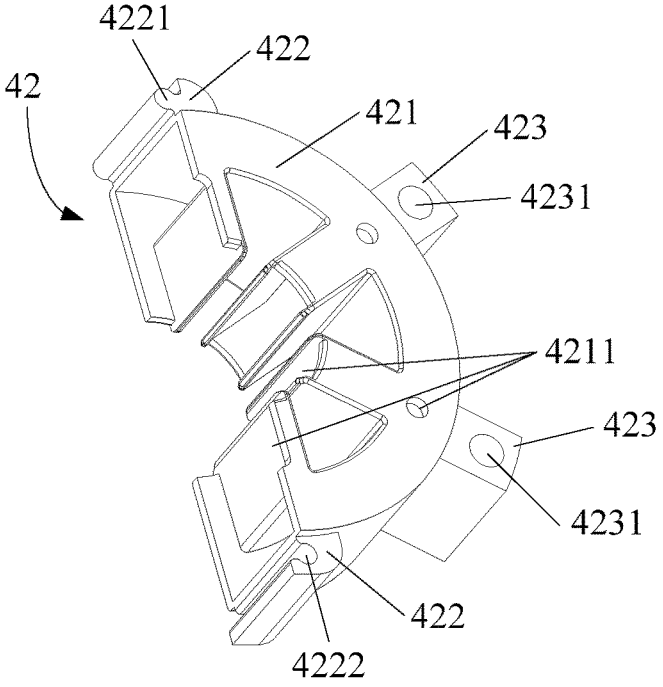
FIG. 17 is a schematic diagram of the insulation structure in an embodiment of the present disclosure.
Figure 18:
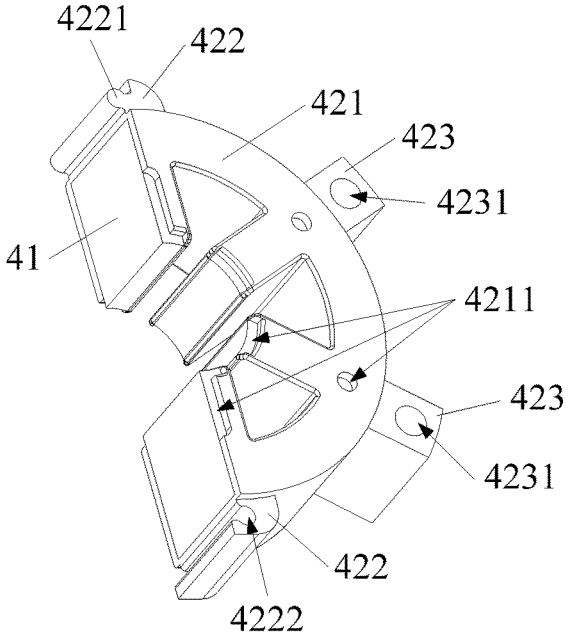
FIG. 18 is a schematic diagram of the stator core petal structure in an embodiment of the present disclosure.
Figure 19:
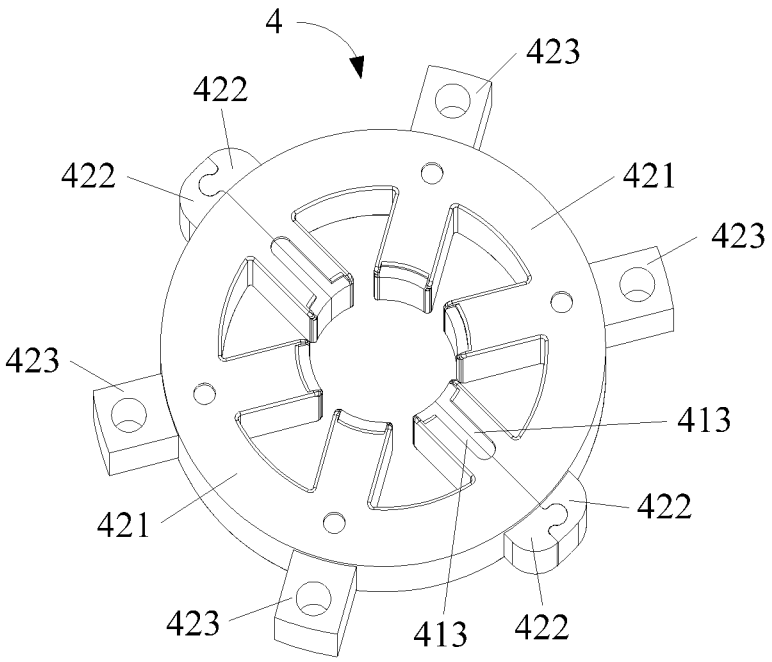
FIG. 19 is a schematic diagram of the structure of stator core petal after the splicing is completed in an embodiment of the present disclosure.

Optionally, as shown in FIGS. 3, 9 and 13, the housing 3 is an injection molding housing. The bearing chamber 33 of the housing 3 is provided with a bearing positioning hole 331, the inner wall of the bearing positioning hole 331 is provided with a glue-containing groove 332, and a bearing sleeve 8 is installed in the bearing chamber 33. There is a transitional fit between the bearing sleeve 8 and the bearing positioning hole 331. The thermosetting glue is used to bond and fix the bearing chamber 33. As shown in FIGS. 14 and 15, the bearing 21 of the rotor assembly 2 is installed in the bearing sleeve 8, and the bearing sleeve 8 and the bearing 21 are in clearance fit with each other, and are bonded and fixed by metal-to-metal glue.

The housing 3 adopts non-metallic injection molding housing, which can reduce motor loss, thereby improving motor efficiency; at the same time, compared with metal housing, the injection molding housing does not generate heat due to eddy current, which accordingly reduces the external working environment temperature of the bearing and improves the reliability of the bearing. There is a bearing positioning hole 331 in the bearing chamber 33, and a transition fit between the bearing positioning hole 331 and the bearing 21 (or bearing sleeve 8) is adopted to realize the pre-positioning of the bearing and ensure the coaxiality of the bearing installation, which is beneficial to improve the assembly accuracy of the bearing and ensure the working reliability of the bearing. And the thermosetting glue can be used to bond and fix the bearing chamber 33 and the bearing 21 of the injection molding housing. The glue flows into and fills the glue-containing groove 332 to achieve a firm bond between the bearing chamber 33 and the bearing 21 (or bearing sleeve 8), thereby ensuring the reliability of bearing in high temperature working environment. Moreover, the injection molding housing is superior to the metal housing in terms of manufacturing cost and weight.

In some embodiments of the present disclosure, as shown in FIGS. 3 to 8, the electric blower also comprises a wind hood 1, the wind hood 1 is installed externally to an end of the housing 3, and the housing 3 and the wind hood 1 are each provided with a mating side surface, respectively, which are adapted to engage each other. One of the mating side surfaces is provided with a pre-positioning rib protruding toward the other mating side surface.

Figure 6:
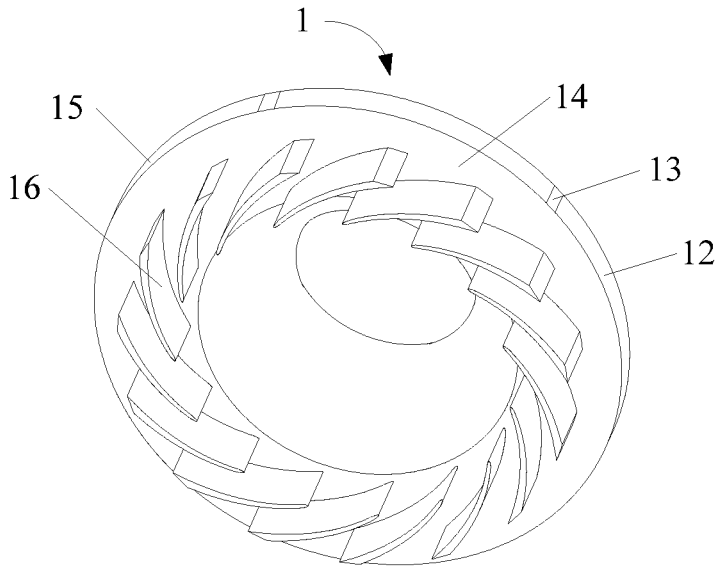
FIG. 6 is a schematic diagram of the wind hood structure in another embodiment of the present disclosure.

Optionally, as shown in FIG. 3, the housing 3 has a mating side surface 311 adapted to the wind hood 1, and the mating side surface 311 is provided with a pre-positioning rib 312; optionally, as shown in FIG. 6, the wind hood 1 has a mating side surface 12 adapted to the housing 3, and the mating side surface 12 is provided with a pre-positioning rib 13.

In the above-mentioned embodiment, by setting the pre-positioning rib on the mating side surface between the housing 3 and the wind hood 1, the pre-positioning rib plays a pre-positioning role during the assembly of the wind hood 1 and the housing 3, thereby ensuring the gap between the wind hood 1 and the moving impeller 22 installed inside the wind hood 1, controls the assembly accuracy of the air duct, and prevents friction caused by the gap deviation of the wind hood 1 and the moving impeller 22 during the assembly process. This ensures the stable performance of the electric blower, and reduces the vibration and noise caused by the poor assembly accuracy of the air duct, thereby ensuring the working efficiency and reliability of the electric blower, and has the advantages of low vibration, low noise, and high fan efficiency, etc.

Optionally, as shown in FIGS. 2, 5, 7 and 8, an inner chamfer 11 is formed at the air inlet of the wind hood 1, and the air inlet is in an open bell mouth shape, which can reduce the wind resistance of the air inlet and significantly improve the performance of the electric blower.

Figure 5:
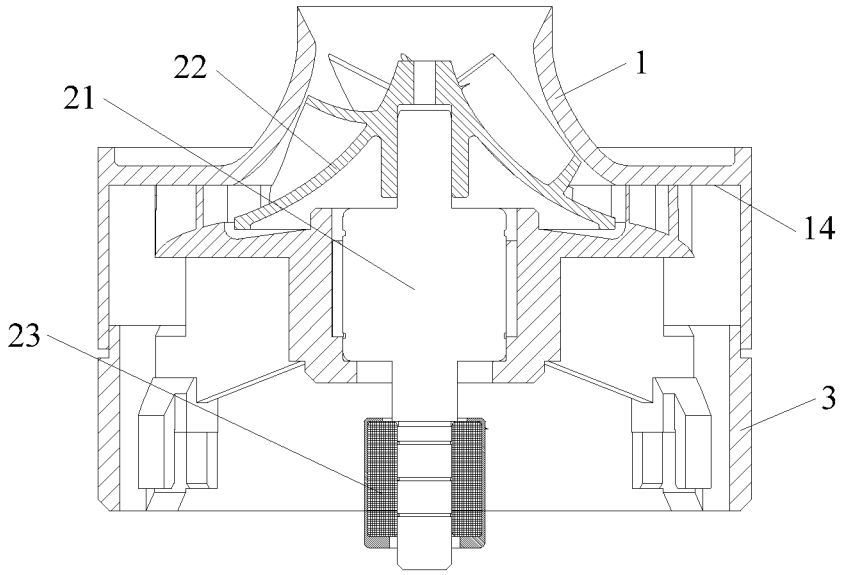
FIG. 5 is a schematic diagram of the assembly structure of housing and a rotor assembly and a wind hood shown in FIG. 3.
Figure 8:
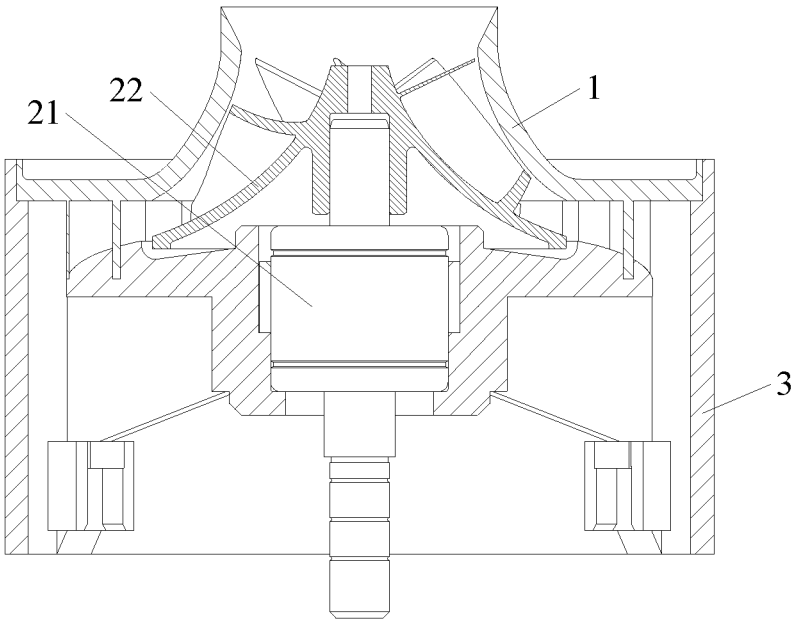
FIG. 8 is a schematic diagram of the assembly structure of the wind hood and the rotor assembly and the housing shown in FIG. 6.

Optionally, as shown in FIGS. 5 and 8, the wind hood 1 is set on the outside of the moving impeller 22, one end of the inner chamfer 11 far away from the air inlet end of the wind hood 1 is recorded as a tail end, and the tail end of the inner chamfer 11 is not lower than the tip of the blade of the moving impeller 22. Optionally, the tail end of the inner chamfer 11 is smoothly transitionally connected to the inner wall surface of the wind hood 1 connected to it, so that the air flow field in the wind hood 1 is smoother, which is beneficial to further improve the performance of the electric blower.

In an embodiment of the present disclosure, as shown in FIGS. 1 to 5, the housing 3 comprises a support shell 31 and a diffuser blade 32 provided on the support shell 31, and the diffuser blade 32 and the support shell 31 are integrally injection molded.

The diffuser blade 32 and the support shell 31 are integrally injection molded to become an integral injection molded housing 3, eliminating the assembly process of the diffuser blade 32 and the housing 3, ensuring the stop dimensional accuracy of the plane of the diffuser blade 32 and the bearing chamber 33 of the housing 3, and improving the assembly precision of the air duct system, thereby improving the performance of the electric blower, and reducing the vibration and noise caused by the poor assembly accuracy of the air duct part. In addition, the integral injection molding of the diffuser blade 32 and the support shell 31 can solve the problem of demoulding marks in the diffuser blade air duct; the above guarantees the smoothness of the air duct and the consistency of assembly, thereby ensuring the stable performance of the electric blower. At the same time, compared with the metal housing, the integrated injection housing 3 reduces the weight and manufacturing cost of the whole machine.

Further, as shown in FIG. 5, the wind hood 1 has a positioning plane that faces away from the air inlet end face of the wind hood 1, and a surface of the diffuser blade 32 facing the positioning plane 14 is attached to the positioning plane 14 to realize the axial positioning of the wind hood, which is convenient for the glue operation between the wind hood and the housing.

Figure 7:
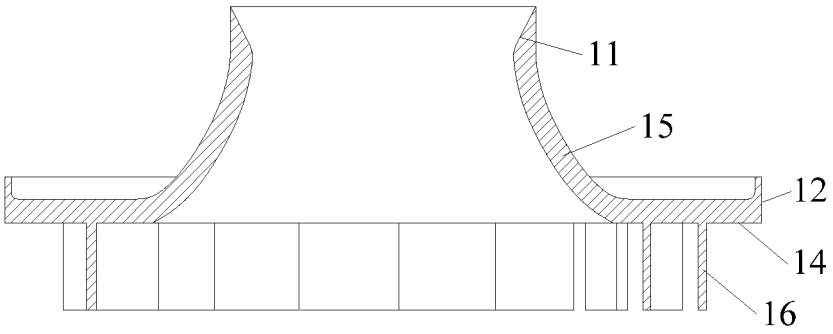
FIG. 7 is a schematic diagram of the cross-sectional structure of wind hood shown in FIG. 6.

In another embodiment of the present disclosure, as shown in FIGS. 6 to 8, the wind hood 1 comprises a wind hood body 15 and a diffuser blade 16 provided on the wind hood body 15, the diffuser blade 16 and the wind hood body 15 are integrally injection molded.

The diffuser blade 16 and the wind hood body 15 adopt integral injection molding, which can avoid the assembly gap between the diffuser blade 16 and the wind hood 1, thereby ensuring the air-tightness of the air duct system, reducing fluid loss along the way, and improving the performance of the electric blower.

Figure 4:
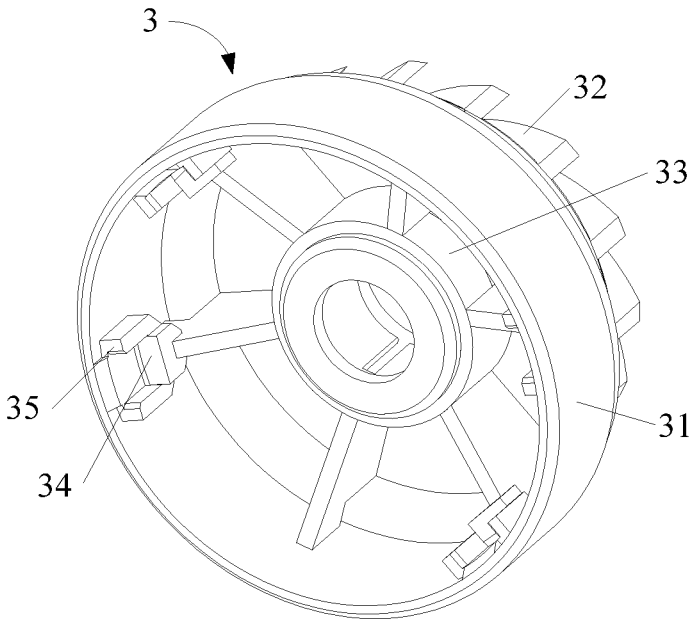
FIG. 4 is a schematic diagram of the housing structure shown in FIG. 3 from another perspective.
Figure 10:
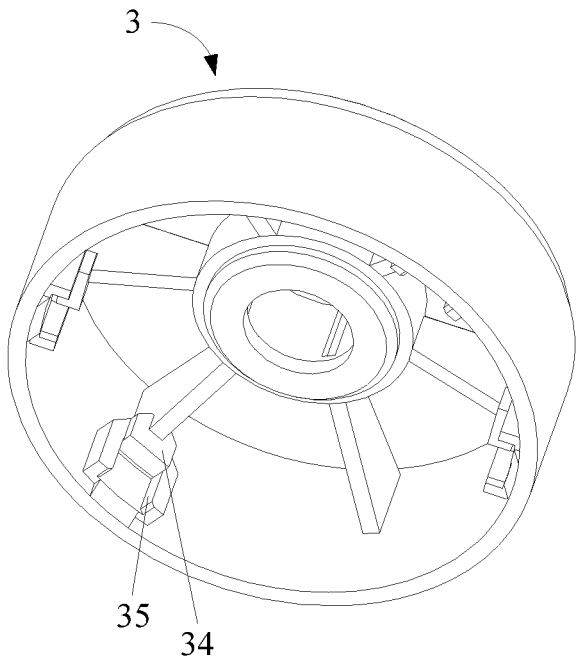
FIG. 10 is a schematic diagram of the housing structure shown in FIG. 9 from another perspective.

In some embodiments of the present disclosure, the electric blower further comprises a stator core 4, as shown in FIGS. 4 and 10, the housing 3 is provided with an iron core fixing seat 34, and the iron core fixing seat 34 is provided with an iron core positioning slot 35. The iron core fixing seat 34 can position the stator core 4 in an axial direction, and the iron core positioning slot 35 can position the stator core 4 in a circumferential direction.

When the stator core 4 and the housing 3 are assembled, the iron core fixing seat 34 is used to implement the axial positioning of the stator core 4, and the iron core positioning slot 35 is used to implement the circumferential positioning of the stator core 4, which facilitates the subsequent use of glue or screwing to fix the stator core 4 in all directions.

In some embodiments of the present disclosure, as shown in FIGS. 16 to 21, the stator core 4 is formed by splicing at least two stator core petals, each of the stator core petals comprises a core body 41 and an insulation structure 42, and the insulation structure 42 comprises a thin-wall structure 421 wrapped around the core body 41 and a splicing part structure 422 extending outwardly from the thin-wall structure 421, the splicing part structure 422 is used for splicing the two adjacent stator core petals.

Further, as shown in FIGS. 16 to 21, the insulation structure 42 also comprises a supporting part structure 423 extending outwardly from the thin-wall structure 421, and the supporting part structure 423 is provided with a positioning hole 4231 or a positioning protrusion, and the positioning hole 4231 or the positioning protrusion are used to cooperate with a mounting seat 5 of the electric blower to achieve pre-positioning.

The insulation structure 42 of the stator core 4 not only undertakes the function of electrical insulation, but also undertakes the role of splicing and fastening each of the stator core petals and supporting the entire stator core 4 in the final assembly. Compared with the self-splicing and self-supporting structure of the stator core 4 in the prior art, the embodiment of the present disclosure reduces the weight of the stator core 4 and reduces the iron loss of the stator core 4, thereby improving the performance of the motor. And this kind of stator core 4 can increase the bonding force between the sheets of the stator core 4 and the damping of the structure of the stator core 4, thereby reducing the noise and vibration of the motor. When the stator core 4 and the mounting seat 5 are assembled, the positioning hole 4231 or the positioning protrusion designed on the supporting part structure 423 is used to achieve the pre-positioning effect of the mounting seat 5 and the stator core 4 when assembling, which is convenient for subsequent fixing and wiring between the mounting seat 5 and the stator core 4.

Optionally, as shown in FIGS. 16 to 20, the core body 41 comprises a core yoke 411, at least one core tooth 412, and at least two sub core teeth 413, the two sub core teeth 413 are both provided inside the core yoke 411 and located at both ends of the core yoke 411 respectively in the circumferential direction, the core tooth 412 are provided inside the core yoke 411 and located between the two sub core teeth 413; the insulation structure 42 comprises two of the splicing part structures 422 which are respectively opposed to the two sub core teeth 413 and extend along a direction away from a center of the sub core teeth 413, and at least one of the supporting part structures 423 opposite to the core tooth 412 and extending along a direction away from a center of the core tooth 412.

The splicing part structure 422 is opposite to the sub core teeth 413, which is conducive to improving the structural strength of the splicing part structure 422, thereby increasing the structural strength of the two adjacent stator core petals using the splicing part structure 422 to splice together, thereby increasing the overall strength of the stator core 4. The supporting part structure 423 is opposite to the core tooth 412, which is beneficial to improve the structural strength of the supporting part structure 423, thereby increasing the supporting strength of the supporting part structure 423 to the entire stator core 4.

In an embodiment of the present disclosure, as shown in FIGS. 16 to 19, The stator core 4 is formed by splicing two stator core petals. In the shown embodiment, the number of the at least one core tooth 412 of each stator core petal is two and they are arranged at intervals along the circumferential direction of the core yoke 411. The insulation structure 42 of each of stator core petals comprises two splicing part structures 422, and the two splicing part structures 422 are located at both ends of the thin-wall structure 421 in the circumferential direction. One splicing part structure 422 is provided with a raised part 4221, and the other splicing part structure 422 is provided with a recessed part 4222. The splicing between two adjacent stator core petals is realized through the cooperation of the raised part 4221 of one splicing part structure 422 and the recessed part 4222 of the other splicing part structure 422. The insulation structure 42 of each stator core petal also comprises two supporting part structures 423, the two supporting part structures 423 are respectively opposite to the two core teeth 412 and extend along the direction away from the center of the core teeth 412 opposite to it, and each supporting part structure 423 is provided with a positioning hole 4231.

Figure 20:
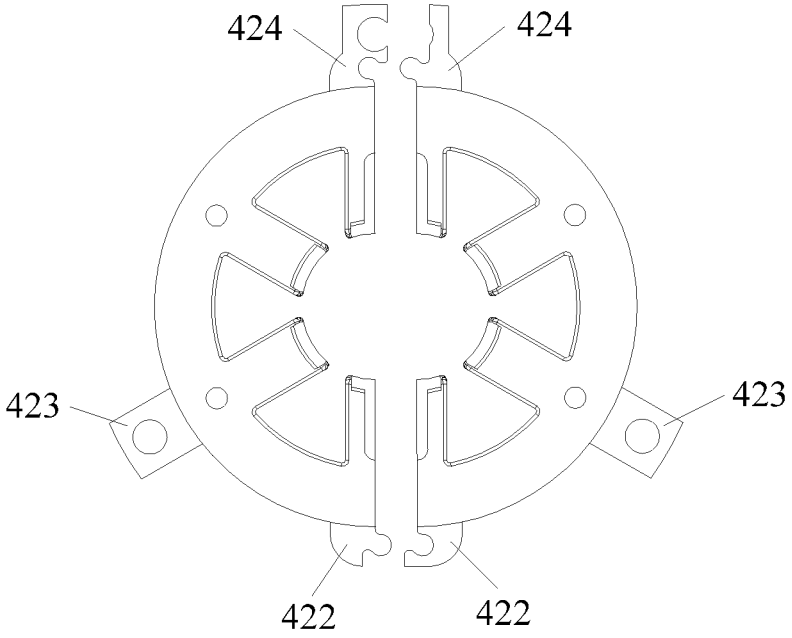
FIG. 20 is a schematic diagram of the structure of stator core petal before splicing in another embodiment of the present disclosure.
Figure 21:
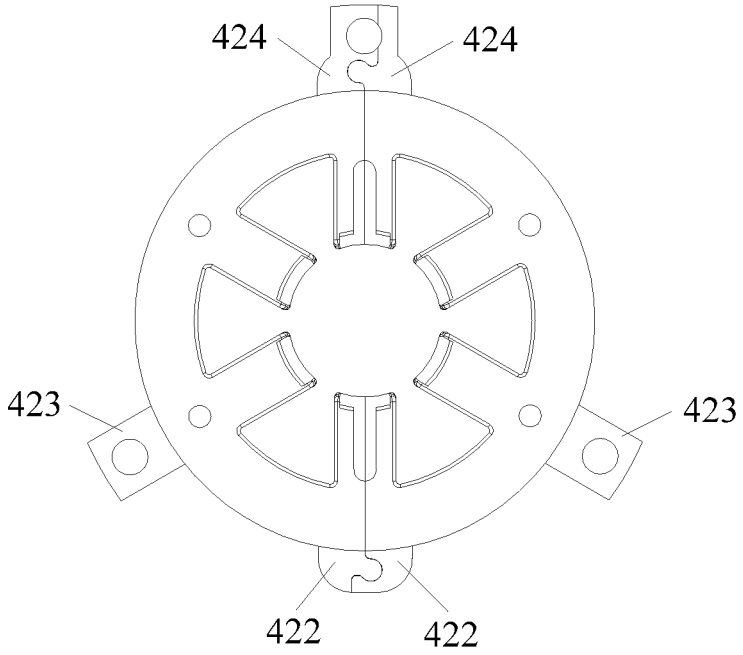
FIG. 21 is a schematic diagram of the structure of stator core petal shown in FIG. 20 after the splicing is completed.

In another embodiment of the present disclosure, as shown in FIGS. 20 and 21, the stator core 4 is formed by splicing two stator core petals. The number of the at least one core tooth 412 of each stator core petal is two and they are arranged at intervals along the circumferential direction of the core yoke 411. The insulation structure 42 of each stator core petal comprises two splicing part structures 422, and the two splicing part structures 422 are located at both ends of the thin-wall structure 421 in the circumferential direction. One splicing part structure 422 is provided with a raised part 4221, and the other splicing part structure 422 is provided with a recessed part 4222. The splicing between two adjacent stator core petals is realized through the cooperation of the raised part 4221 of one splicing part structure 422 and the recessed part 4222 of the other splicing part structure 422. The insulation structure 42 of each stator core petal also comprises two supporting part structures 423, one of the supporting part structures 423 is opposite to one of the two core teeth 412 and extends along the direction away from the center of the core teeth 412 opposite to it, and the supporting part structure 423 is provided with a positioning hole 4231; another supporting part structure 423 merges with one of the splicing part structures 422 to form a composite structure 424.

For example, in the two composite structures 424 spliced together, half of the composite structure 424 is provided with a first positioning hole smaller than a semicircle, and the other half of the composite structure 424 is provided with a second positioning hole larger than a semicircle. The two halves of the composite structure 424 are spliced, so that the first positioning hole and the second positioning hole are spliced into a complete circular positioning hole 4231. And one half of the composite structure 424 is provided with a raised part 4221 and the other half of the composite structure 424 is provided with a recessed part 4222, and the two halves of the composite structure 424 are spliced, so that the raised part 4221 and the recessed part 4222 cooperate to realize the splicing of the two stator core petals. That is to say, this embodiment combines the two supporting part structures 423 and one splicing part structure 422 of the two stator core petals in the above-mentioned embodiment to form a composite structure 424, which reduces the number of the splicing part structure 422 or the supporting part structure 423, thereby reducing the weight of the material and the weight of the stator core 4.

Optionally, the insulation structure 42 is an injection molded body, an injection molding process hole 4211 is formed on the thin-wall structure 421, and the injection molding process hole 4211 may be a regular or irregular hole structure, which supports the core body 41 during the injection molding process.

Figure 1:
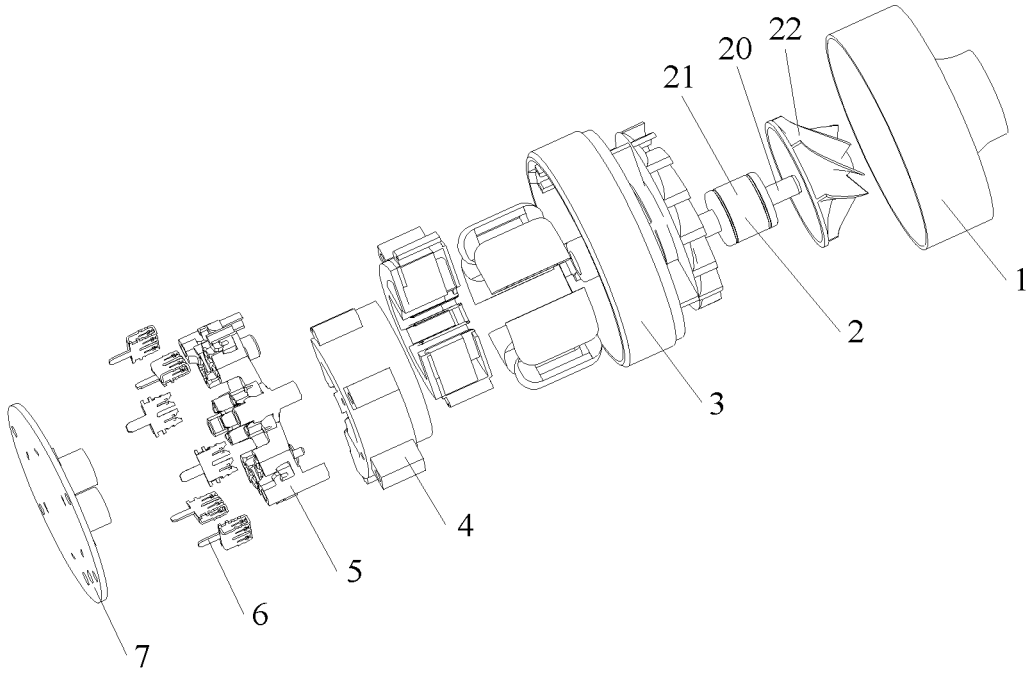
FIG. 1 is a schematic diagram of the decomposition structure of an electric blower in an embodiment of the present disclosure.

In an embodiment of the present disclosure, as shown in FIGS. 1 and 2, the electric blower also comprises a stator core 4 and the mounting seat 5, the stator core 4 is installed inside of one end of the housing 3, the mounting seat 5 is installed at one end of the stator core 4 away from the housing 3, and the mounting seat 5 is provided with a terminal slot for accommodating a terminal 6, a stator assembly is formed between the mounting seat 5 and the stator core 4 by pulling wires and tapping terminals.

Further, as shown in FIGS. 1 and 2, an end plate is installed at one end of the mounting seat 5 away from the stator core 4, and the stator assembly and the end plate are connected by welding with terminal 6.

In an embodiment, the end plate is a PC board 7, and the stator assembly and the PC board 7 are connected by welding with six terminals 6.

In an embodiment, as shown in FIGS. 1 and 2, the electric blower comprises a wind hood 1, a rotor assembly 2, an integrated housing 3, a stator core 4, a plastic mounting seat 5, a terminal 6 and a PC board 7. The wind hood 1 is installed externally to an end of the integrated housing 3, and the stator core 4 is installed inside the other end of the integrated housing 3. The integrated housing 3 is an integral injection molding of the diffuser blade 32 and the support shell 31, comprising a bearing chamber 33 and an iron core fixing structure; the air inlet of the wind hood 1 is trumpet-shaped, the wind hood 1 and the housing 3 are provided with a pre-positioning rib 312, the wind hood 1 and the integrated housing 3 realize the axial positioning of the wind hood through the surface positioning of the positioning plane 14 and the diffuser blade 32 on the wind hood 1. The rotor assembly 2 comprises a moving impeller 22, a bearing 21 and a magnetic ring 23, and the rotor assembly 2 and the housing 3 are fixed by glue. The stator core 4 comprises a core yoke 411, a plurality of core teeth 412 and an insulation structure 42 wrapped around the core. The iron core positioning slot 35 on housing 3 is used to achieve pre-positioning between the stator core 4 and the integrated housing 3, and the full positioning can also be achieved by gluing or using screws. The plastic mounting seat 5 comprises a terminal slot and a fixed structure. The plastic mounting seat 5 and the stator core 4 are first positioned through a pre-positioning structure (such as the positioning hole 4231 on the supporting part structure 423), and then the full positioning is achieved by pulling the wires and tapping the terminals 6. The PC board 7 is fixed by welding the terminal 6 (such as, six terminals 6).

Optionally, the stator core 4, the housing 3, and the PC board 7 are connected by screws.

The electric blower may be a high-speed electric blower.

In summary, the electric blower provided by the present disclosure can effectively improve the assembly accuracy of the air duct and reduce the energy loss of the air duct. At the same time, the stator core structure of this electric blower can reduce the weight of the whole machine and reduce the iron loss of the motor in high frequency applications. At the same time, the electric blower provided by the present disclosure has the characteristics of low vibration, low noise, and high fan efficiency.

In the description of the present disclosure, it should be understood that the orientation or position relationships indicated by the terms "inside", "outside" and the like are the orientation or position relationships based on what is shown in the drawings, are merely for the convenience of describing the present disclosure and simplifying the description, and do not indicate or imply that the device or unit referred to must have a particular direction and is constructed and operated in a specific orientation, and thus cannot be understood as the limitation of the present disclosure.

In the present disclosure, the term "connected", "connection", "fixing" and the like should be understood in a broad sense, unless otherwise clearly specified and limited. For example, "connection" may be a fixed connection, and may also be a removable connection, or an integral connection; and "connected" may refer to direct connection and may also refer to indirect connection through an intermediary. A person of ordinary skills in the art could understand the specific meaning of the terms in the present disclosure according to specific situations.

In the description of the specification, the descriptions of the terms "one embodiment", "some embodiments" and "specific embodiments" and the like mean that specific features, structures, materials or characteristics described in conjunction with the embodiment(s) or example(s) are included in at least one embodiment or example of the present disclosure. In the specification, the schematic representation of the above terms does not necessarily refer to the same embodiment or example. Moreover, the particular features, structures, materials or characteristics described may be combined in a suitable manner in any one or more embodiments or examples.

The descriptions above are not used to limit the present disclosure. For a person skilled in the art, the present disclosure may have various changes and variations. Any modifications, equivalent substitutions, improvements etc. within the spirit and principle of the present disclosure shall all be included in the protection scope of the present disclosure.

What is claimed is:

1. An electric blower comprising:

a rotor assembly comprising a bearing having two ends, a moving impeller and a magnetic ring, wherein the magnetic ring and the moving impeller are installed at the two ends of the bearing respectively; and a housing defining a bearing chamber, wherein a diameter of the magnetic ring is smaller than a diameter of the bearing chamber such that the magnetic ring is configured to pass through the bearing chamber, wherein the moving impeller and the magnetic ring are respectively located at two ends of the bearing chamber respectively, wherein:

the housing comprises an injection molding housing, the bearing chamber is provided with a bearing positioning hole, an inner wall of the bearing positioning hole is provided with a glue-containing groove, and after the bearing is installed in the bearing chamber, a transitional fit is provided between the bearing and the bearing positioning hole.

2. The electric blower according to claim 1, wherein:

an annular step extending radially inwardly is provided in the bearing chamber, the magnetic ring is configured to pass through a middle of the annular step, and the bearing is restricted in the bearing chamber by the annular step.

3. The electric blower according to claim 1, wherein:

the bearing comprises a bearing sleeve installed in the bearing chamber, a transitional fit is provided between the bearing sleeve and the positioning hole, and the bearing is installed in the bearing sleeve.

4. The electric blower according to claim 1, further comprising a wind hood, wherein the wind hood is installed externally to an end of the housing, and wherein the housing and the wind hood each comprise a mating side surface adapted to engage each other, one of the mating side surfaces being provided with a pre-positioning rib protruding toward the other mating side surface.

5. The electric blower according to claim 1, further comprising a wind hood, wherein the wind hood is installed externally to an end of the housing, an inner chamfer is formed at an air inlet of the wind hood, and the air inlet is of an open bell mouth shape.

6. The electric blower according to claim 1, wherein:

the housing comprises a support shell and a diffuser blade provided on the support shell, and the diffuser blade and the support shell are integrally injection molded.

7. The electric blower according to claim 6, further comprising a wind hood, wherein the wind hood is installed externally to an end of the housing, the wind hood has a positioning plane that faces away from the air inlet end face of the wind hood, and a surface of the diffuser blade facing the positioning plane is attached to the positioning plane.

8. The electric blower according to claim 1, further comprising a wind hood, wherein the wind hood is installed externally to an end of the housing, the wind hood comprises a wind hood body and a diffuser blade provided on the wind hood body, the diffuser blade and the wind hood body are integrally injection molded.

9. The electric blower according to claim 1, further comprising a stator core, wherein the housing is provided with an iron core fixing seat, the iron core fixing seat is provided with an iron core positioning slot, and the stator core is positionable by the iron core fixing seat in an axial direction, the stator core is positionable by the iron core positioning slot in a circumferential direction.

10. The electric blower according to claim 1, further comprising a stator core, wherein the stator core is formed by splicing at least two stator core petals, each of the stator core petals comprises a core body and an insulation structure, the insulation structure comprises a thin-wall structure wrapped around the core body and a splicing part structure extending outwardly from the thin-wall structure, and the splicing part structure is used for splicing the two adjacent stator core petals.

11. The electric blower according to claim 10, wherein:

the insulation structure further comprises a supporting part structure extending outwardly from the thin-wall structure, and the supporting part structure is provided with a positioning hole or a positioning protrusion, and the positioning hole or the positioning protrusion are used to cooperate with a mounting seat of the electric blower to achieve pre-positioning.

12. The electric blower according to claim 11, wherein:

the core body comprises a core yoke, at least one core tooth, and at least two sub core teeth, the two sub core teeth are both provided inside the core yoke and located at both ends of the core yoke in the circumferential direction respectively, the core tooth is provided inside the core yoke and located between the two sub core teeth, and the insulation structure comprises two of the splicing part structures which are respectively opposed to the two sub core teeth and extend along a direction away from a center of the sub core teeth, and at least one of the supporting part structures opposite to the core tooth and extending along a direction away from a center of the core tooth.

13. The electric blower according to claim 11, further comprising a stator core and the mounting seat, wherein the stator core is installed inside of one end of the housing, the mounting seat is installed at an end of the stator core away from the housing, and the mounting seat is provided with a terminal slot for accommodating a terminal, a stator assembly is formed between the mounting seat and the stator core by pulling wires and tapping terminals.

14. The electric blower according to claim 13, wherein:

an end plate is installed at an end of the mounting seat away from the stator core, and the stator assembly and the end plate are connected through terminal welding.

* * * * *